US005755646A

United States Patent [19]

Chu

[11] Patent Number: 5,755,646

[45] Date of Patent: May 26, 1998

[54] ADJUSTABLE CLOTHES HANGING AND EXERCISING APPARATUS

[76] Inventor: Jack Shao-Chun Chu, 18 S. Elm St., Alhambra, Calif. 91801

[21] Appl. No.: 843,240

[22] Filed: Apr. 14, 1997

[51] Int. Cl.[6] ..... A63B 21/015

[52] U.S. Cl. ..... 482/118; 482/115

[58] Field of Search ..... 482/114, 115, 482/118, 133, 135, 137

[56] References Cited

U.S. PATENT DOCUMENTS

| | | | |
|---|---|---|---|
| 2,921,791 | 1/1960 | Berne | 482/118 |
| 3,731,921 | 5/1973 | Andrews, Jr. | 482/115 |
| 4,385,760 | 5/1983 | Mattox et al. | 482/114 |
| 4,436,303 | 3/1984 | McKillip et al. | 482/118 |
| 5,037,088 | 8/1991 | Bernstein | 482/118 |
| 5,062,633 | 11/1991 | Engel et al. | 482/118 |
| 5,256,124 | 10/1993 | Hughes | 482/118 |
| 5,374,225 | 12/1994 | Wilkinson | 482/114 |

*Primary Examiner*—Lynne A. Reichard
*Attorney, Agent, or Firm*—David & Raymond; Raymond Y. Chan

[57] ABSTRACT

An adjustable clothes hanging and exercising apparatus includes a T-shape supporter which has a horizontal tube and a vertical tube integrally and perpendicularly connected with a lower central portion of the horizontal tube. A left arm supporter has a first end and a second end, wherein one of the first and second ends is detachably connected with the left section of the horizontal tube. A right arm supporter has a first end and a second end, wherein one of the first and second ends is detachably connected with the right section of the horizontal tube. An adjustable device which comprises an adjustable bar having a top end rotatably connected with a bottom end of the vertical tube. A base bar has a top end detachably connected with a bottom end of the adjustable bar. A base supporter is detachably connected with a bottom end of the base bar. Accordingly, the adjustable clothes hanging and exercising apparatus can be assemble to form a clothes hanging stand having a desired height for hanging different type of clothes with different length such as jacket, coat, or suit. It can be adjusted to form an exercising twister for the user to have twisting exercise for relaxing, stretching, and improving blood circulation. Moreover, the adjustable clothes hanging and exercising apparatus does not occupy unnecessary room during operating and is easy to fold up or even entirely disassemble for storing and packaging purposes.

24 Claims, 15 Drawing Sheets

ADJUSTABLE CLOTHES HANGING AND EXERCISING APPARATUS

FIELD OF THE PRESENT INVENTION

The present invention relates to a clothes hanging and exercising apparatus, and more particularly to a coat hanger which can be operated to form an exercising twister for white collar worker to have some light exercise for stretching, releasing stress, and improving blood circulation during work break.

BACKGROUND OF THE PRESENT INVENTION

Most offices provide clothes stands for hanging clothes such as jacket, coat or suit for the white collar workers, so that the jacket, coat, or suit can stay wrinkle free. For the conventional clothes hanging stand, once the worker hangs the clothes thereon, the job of the clothes hanging stand is completed. The clothes hanging stand is just a dull stand that occupies the space and merely provides a single function of clothes hanging.

On the other hands, the conventional exercising equipment is mainly focused on burning high among of calories by doing heavy duty workout such as weight lifted, pull up, tread mill, set up or push up. All above mentioned exercises consume a lot of energy and time. For a white collar worker who probably doesn't have much chance and time to do exercise, it is a perfect idea for them to have an adjustable clothes hanging and exercising apparatus because not only this apparatus can normally be set in the office for clothes hanging, but also it acts as a tension reliever that can relax, stretch the muscle and improve the blood circulation of the worker.

SUMMARY OF THE PRESENT INVENTION

The main objective of the present invention is to provide an adjustable clothes hanging and exercising apparatus which not only comprises a rotatable T-shape supporter that can be adjusted to have a desired height for hanging different type of clothes with different length such as jacket, coat, or suit, but also can be adjusted to form an exercising apparatus for the user to have twisting exercise for relaxing, stretching, and improving blood circulation.

Another objective of the present invention is to provide an adjustable clothes hanging and exercising apparatus which does not occupy unnecessary room during operating and is easy to fold up or even entirely disassemble for storing and packaging purposes.

Accordingly, in order to achieve the above objectives and features, the present invention provides an adjustable clothes hanging and exercising apparatus which comprises an upper supporting device, an adjustable device, a base bar, and a base supporter.

The upper supporting device comprises a T-shape supporter, a left arm supporter and a right arm supporter. The T-shape supporter comprises a horizontal tube having a left section and a right section, and a vertical tube downwardly and perpendicularly connected between said left section and said right section of said horizontal tube, wherein said vertical tube comprises an upper tube, a lower tube and a roller connector connected between said upper tube and said lower tube for enabling said upper tube and said lower tube to rotate relatively and enhancing a smooth connection between said upper tube and said lower tube.

The left arm supporter which comprises an elongated left arm tube and a left turning joint detachably and rotatably connected between a left end of said left section of said horizontal tube and a connecting end of said left arm tube. The right arm supporter which comprises an elongated right arm tube and a right turning joint detachably and rotatably connected between a right end of said right section of said horizontal tube and a connecting end of said right arm tube.

The adjustable device comprises an adjustable bar and an central turning joint detachably connected between a bottom end of said lower tube of said vertical tube and a top end of said adjustable bar.

The base bar is detachably connected with a bottom end of said adjustable bar, wherein said bottom end of said adjustable bar is selectively inserted into a top end of said base bar for a predetermined depth so as to adjust an overall height of said adjustable bar and said base bar. The base supporter is detachably connected with a bottom end of said base bar.

DETAILED DESCRIPTION OF THE PREFERRED EMBODIMENT

Figure 1:
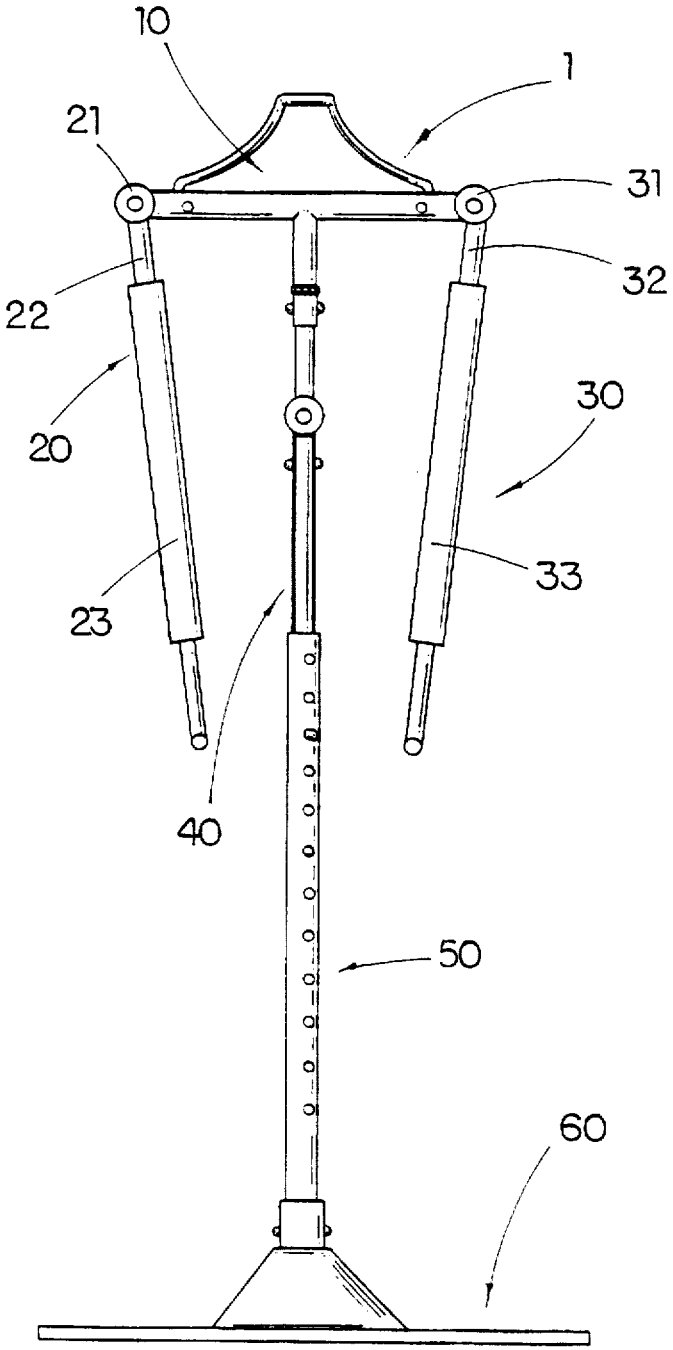
FIG. 1 is a front view of an adjustable clothes hanging and exercising apparatus according to a preferred embodiment of the present invention, in which the adjustable clothes hanging and exercising apparatus is set as a clothes hanging stand for hanging clothes.
Figure 2:
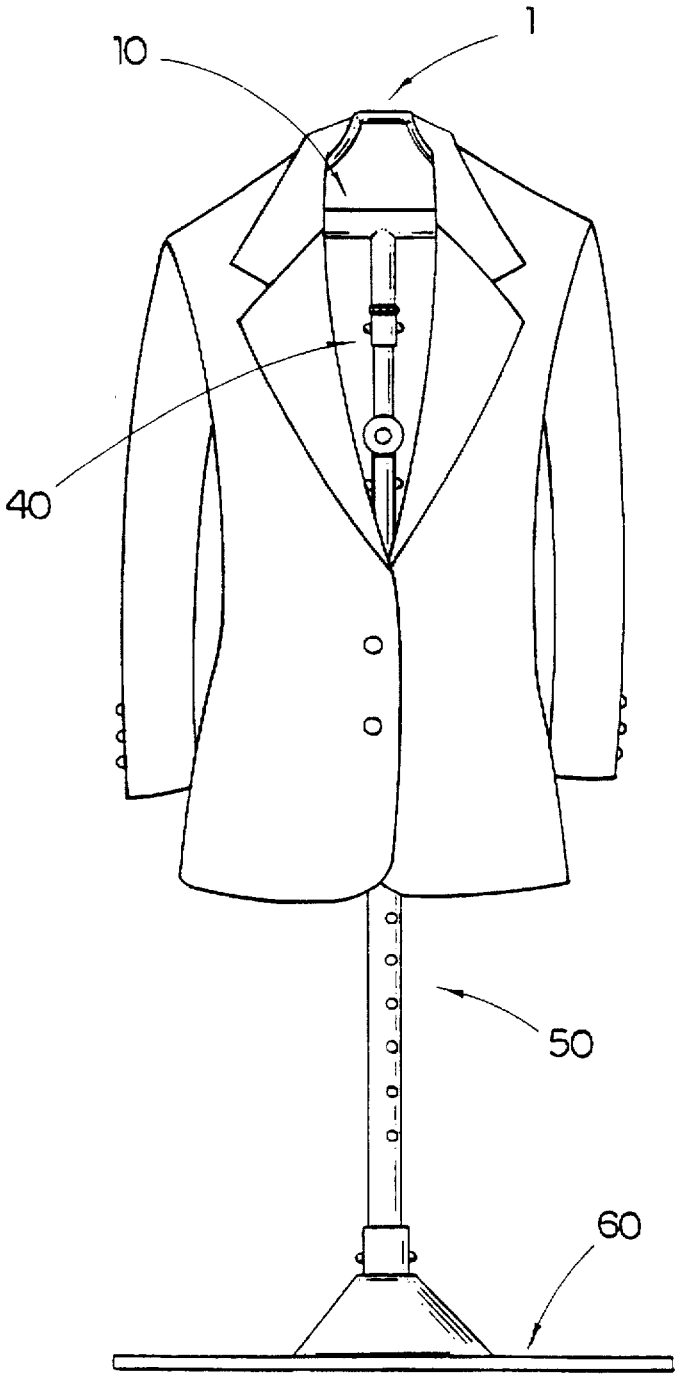
FIG. 2 is a front view of the adjustable clothes hanging and exercising apparatus with a coat hanging thereon according to the above preferred embodiment of the present invention.
Figure 3:
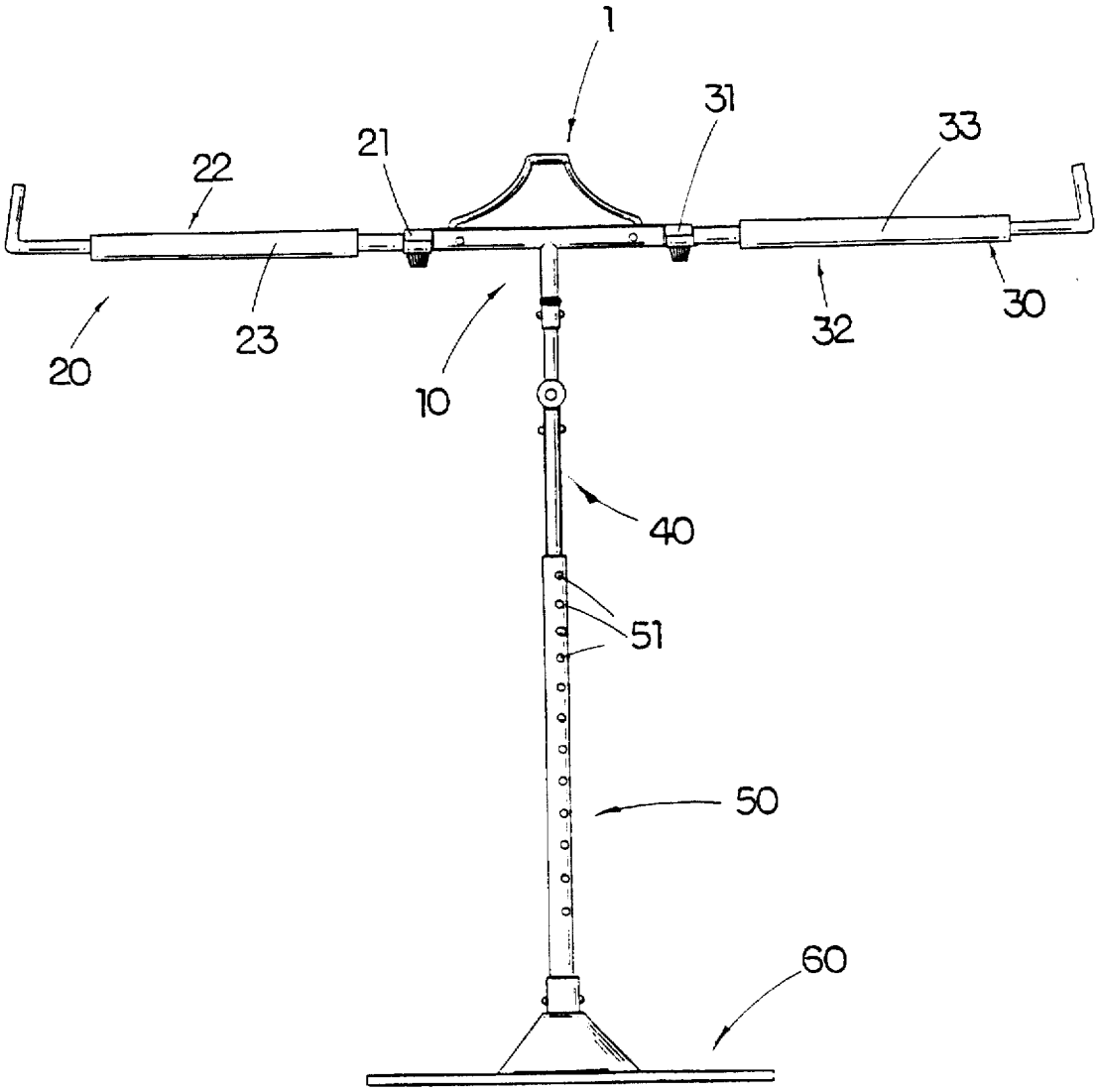
FIG. 3 is a perspective view of the adjustable clothes hanging and exercising apparatus according to the above preferred embodiment of the present invention, in which the adjustable clothes hanging and exercising apparatus is set as an exercising twister.
Figure 7A:
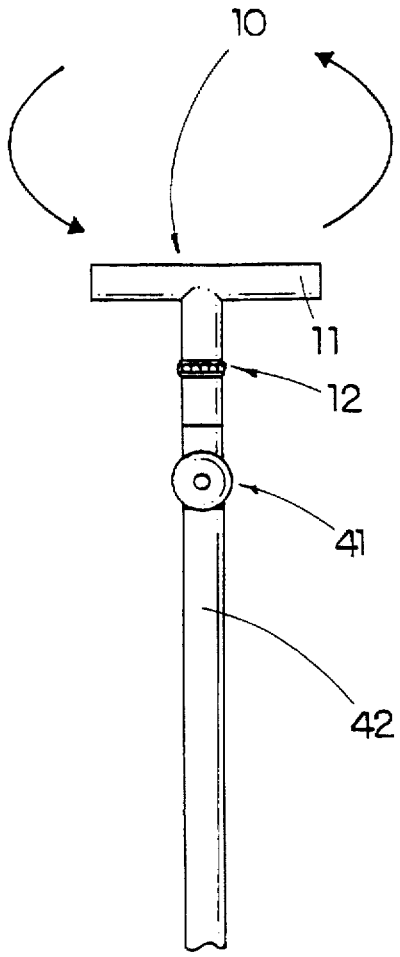
FIG. 7A and FIG. 7B are two partial front views showing the twisting movement of the T-shape supporter according to the above preferred embodiment of the present invention.
Figure 7B:
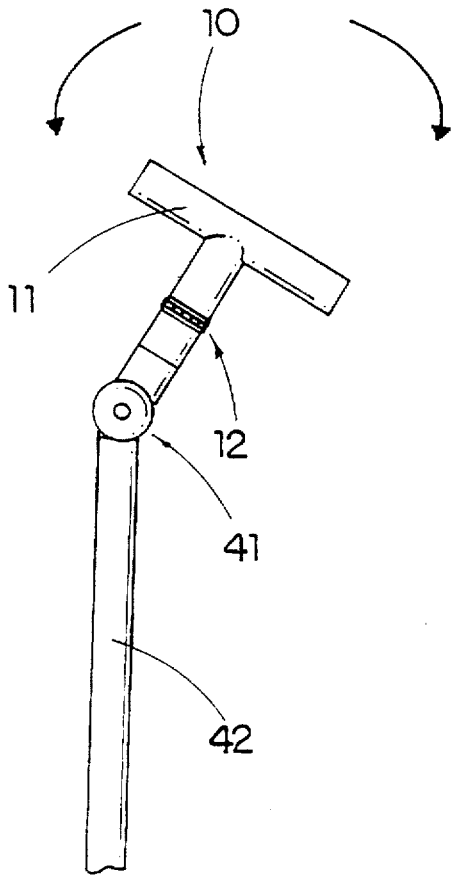
Figure 8:
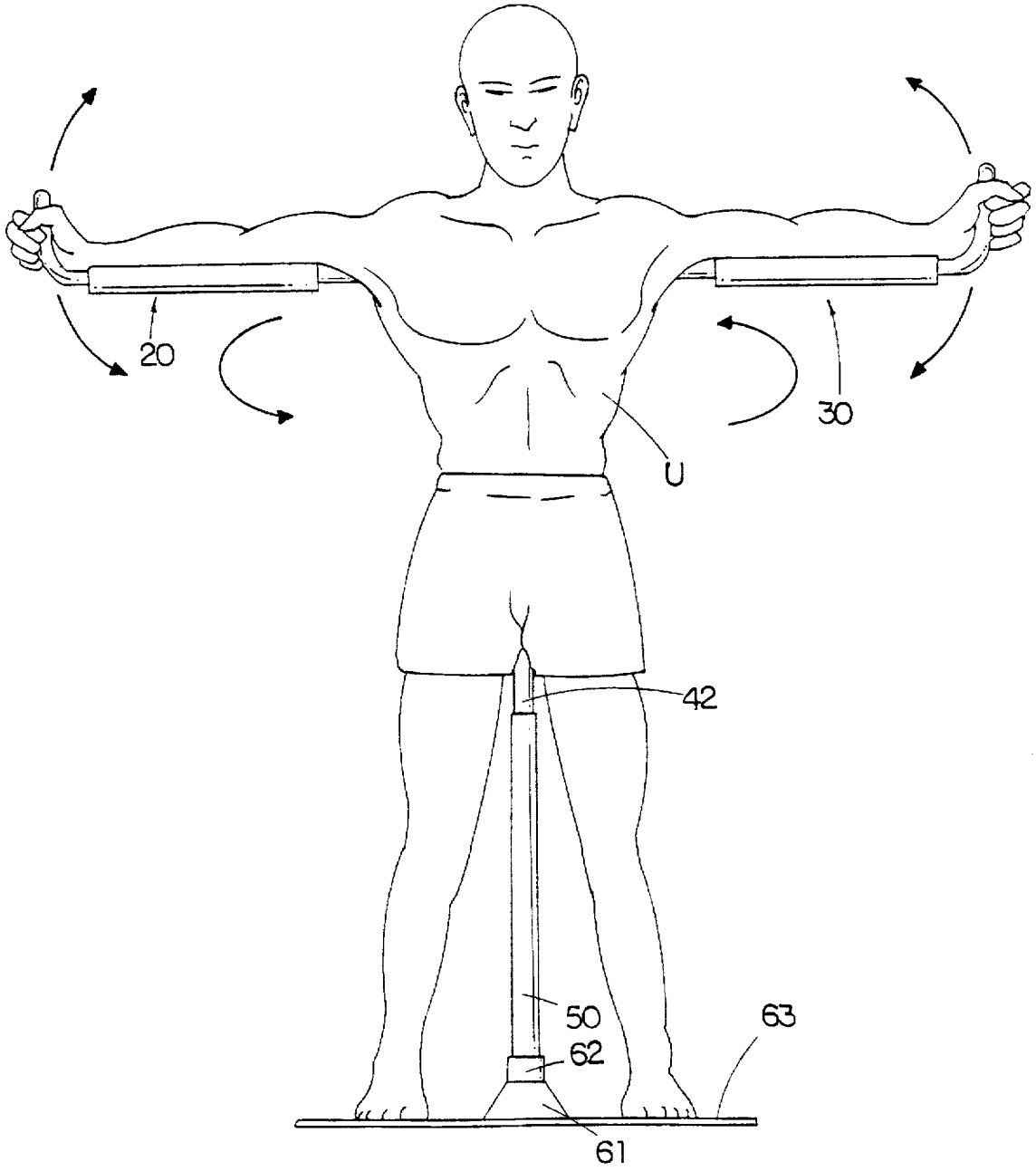
FIG. 8 is a front view of the above preferred embodiment of the present invention, illustrating how do a standing user process the twisting exercise with the adjustable hanging and exercising apparatus.
Figure 9:
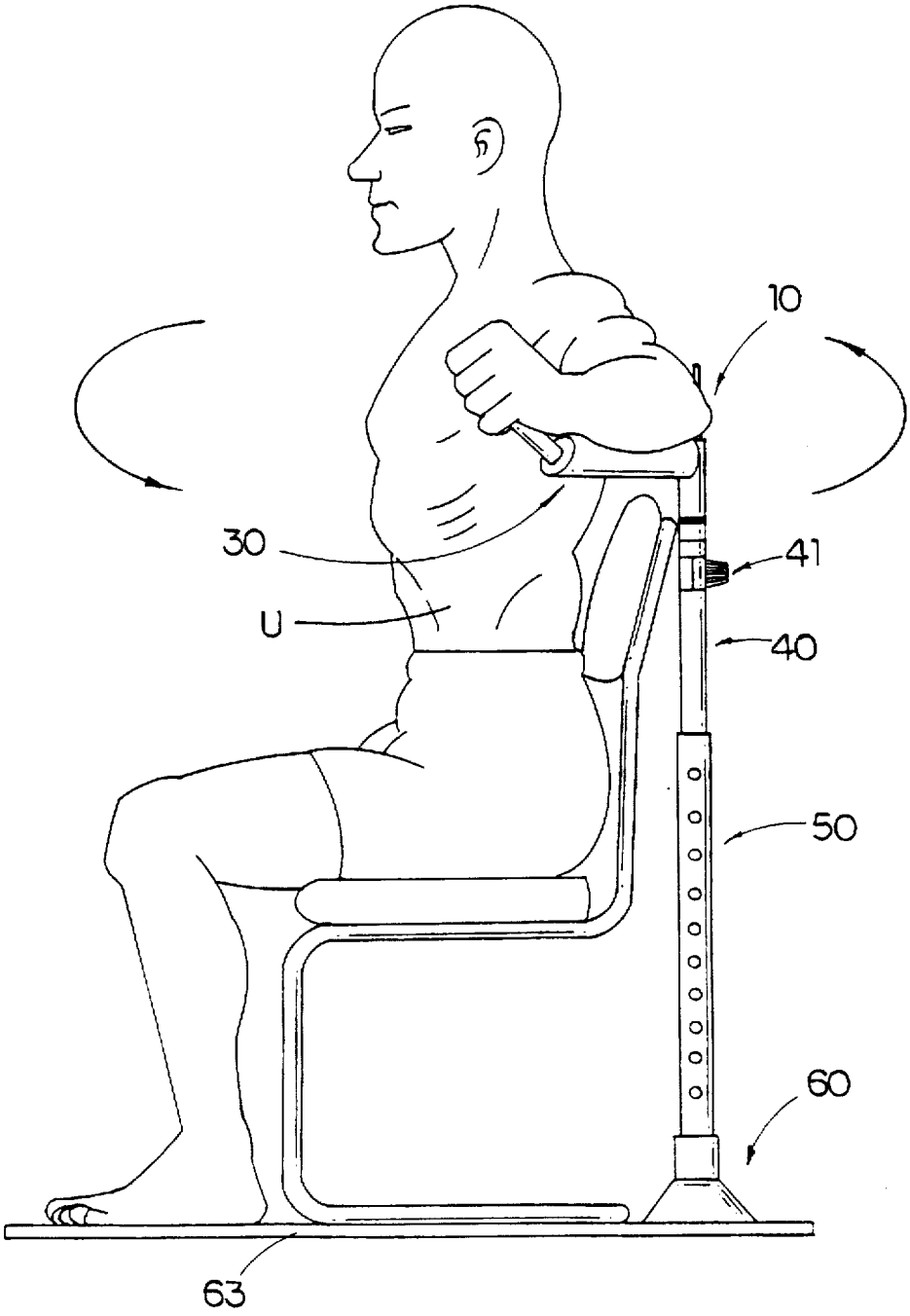
FIG. 9 is a side view of the above preferred embodiment of the present invention, illustrating how do a sitting user process the twisting exercise with the adjustable hanging and exercising apparatus.

Referring to FIGS. 1 to 9 of the drawings, a first preferred embodiment of the present invention of an adjustable clothes hanging and exercising apparatus is illustrated. The adjustable clothes hanging and exercising apparatus has dual functions that it can be selectively adjusted to form a clothes hanging stand for hanging clothes such as jacket, coat, or suit with different length, as shown in FIGS. 1 and 2, or an exercising twister to help the user to relax, stretch, and improve his or her blood circulation, as shown in FIGS. 3, 8 and 9.

Referring to FIGS. 1 and 3 of the drawing, the adjustable clothes hanging and exercising apparatus comprises an upper supporting device 1, an adjustable device 40, a base bar 50, and a base supporter 60, wherein the upper supporting device 1 comprises a T-shape supporter 10, a left arm supporter 20 and a right arm supporter 30.

Figure 4A:
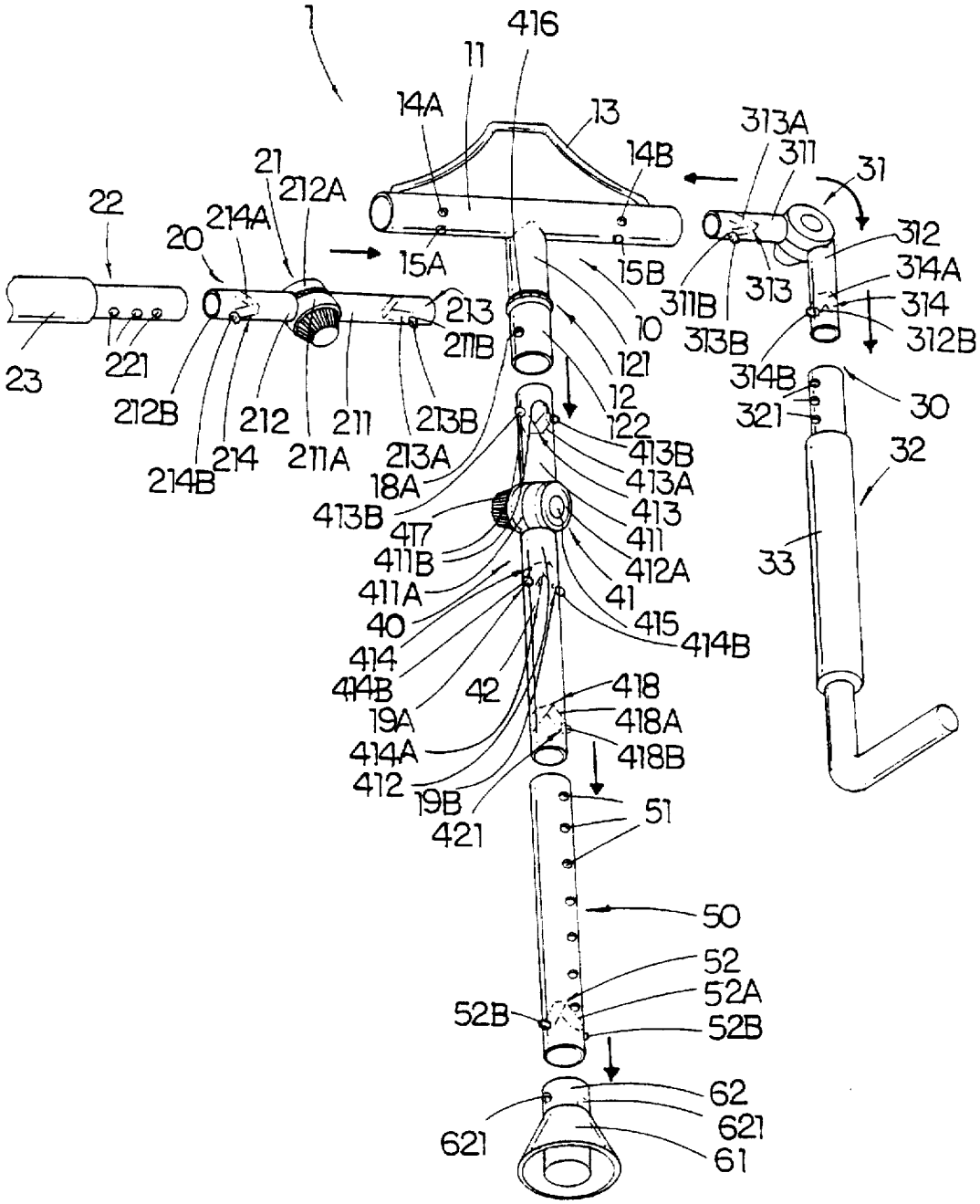
FIG. 4A is a partial exploded perspective view of the upper supporting device of the adjustable clothes hanging and exercising apparatus according to the above preferred embodiment of the present invention.

Referring to FIG. 4, the T-shape supporter 10 comprises a hollow horizontal tube 11, a hollow vertical tube 12 integrally and perpendicularly connected with a lower central portion of the horizontal tube 11, a V-shaped hanger 13 connected to an upper side of the hollow horizontal tube 11 for hanging clothes. The hollow vertical tube 12 comprises an upper tube 121, a lower tube 122 and a roller connector 416 connected between the upper tube 121 and the lower tube 122. As shown in FIGS. 4 and 5, the roller connector 416 can be a ball bearing for enabling the upper tube 121 and the lower tube 122 to rotate relatively and enhancing the smooth connection between the upper tube 121 and the lower tube 122. In other words, if the lower tube 122 is firmly held in position, the upper tube 121 and the horizontal tube 11 of the T-shape supporter 10 can be rotated freely.

The T-shape supporter 10 has two jointing holes 18*a*, 18*b* formed at two opposite sides of the lower tube 122 of the vertical tube 12, and at least two pair of connecting holes 14*a*, 15*a* and 14*b*, 15*b* provided at a predetermined position on the hollow horizontal tube 11, in which one pair of the connecting holes 14*a*, 15*a* are formed on a left section of the horizontal tube 11 while the other pair of the connecting holes 14*b*, 15*b* are formed on a right section of the horizontal tube 11. Moreover, the connecting holes 14*a*, 14*b* are formed on a front side of the horizontal tube 11 with their central axes parallel to the ground. The connecting holes 15*a*, 15*b* are formed on a bottom side of the horizontal tube 11 with their central axes perpendicular to the ground.

The left arm supporter 20, which is connected to a left end of the left section of the hollow horizontal tube 11 of the T-shape supporter 10, comprises a left turning joint 21 and an elongated left arm tube 22. The left turning joint 21 comprises a first turning tube 211 inserted into the left end of the left section of the hollow horizontal tube 11 of the T-shape supporter 10, as shown in FIG. 4A, an second turning tube 212 inserted into a connecting end of the left arm tube 22, a first spring lock 213, and a second spring lock 214. The first spring lock 213 is disposed within the first turning tube 211 at a predetermined position thereof for engaging with the left section of the hollow horizontal tube 11 of the T-shape supporter 10. The second spring lock 214 is disposed within the second turning tube 212 at a predetermined position thereof for engaging with the left arm tube 22.

In order to firmly connect the left turning joint 21 with the left section of the hollow horizontal tube 11 and the left arm tube 22, each of the first and second spring locks 213, 214 is specially designed to comprise a V-shape spring 213*a*, 214*a* which one end protrudes a locking stub 213*b*, 214*b*, wherein the locking stub 213*b* of the first spring lock 213 penetrates through a first positioning hole 211*b* provided on the first turning tube 211 and further plugs through one of the first pair of connecting holes 14*a* or 15*a* formed on the left section of the hollow horizontal tube 11 of the T-shape supporter 10 while another end of the V-shape spring 213*a* pressing against on an inner wall of the first turning tube 211. The locking stub 214*b* penetrates through a second positioning hole 212*b* provided on the second turning tube 212 and further plugs through one of a plural of left arm holes 221 provided on one end of the left arm tube 22.

Figure 4B:
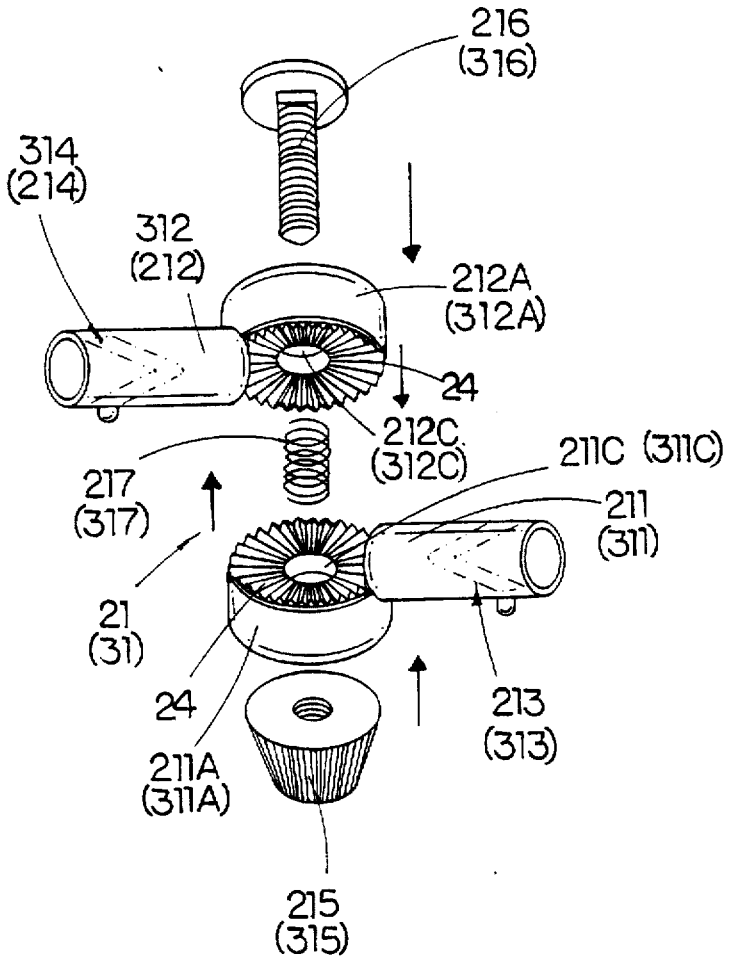
FIG. 4B is an exploded perspective view of a turning joint of the adjustable clothes hanging and exercising apparatus according to the above preferred embodiment of the present invention.
Figure 5:
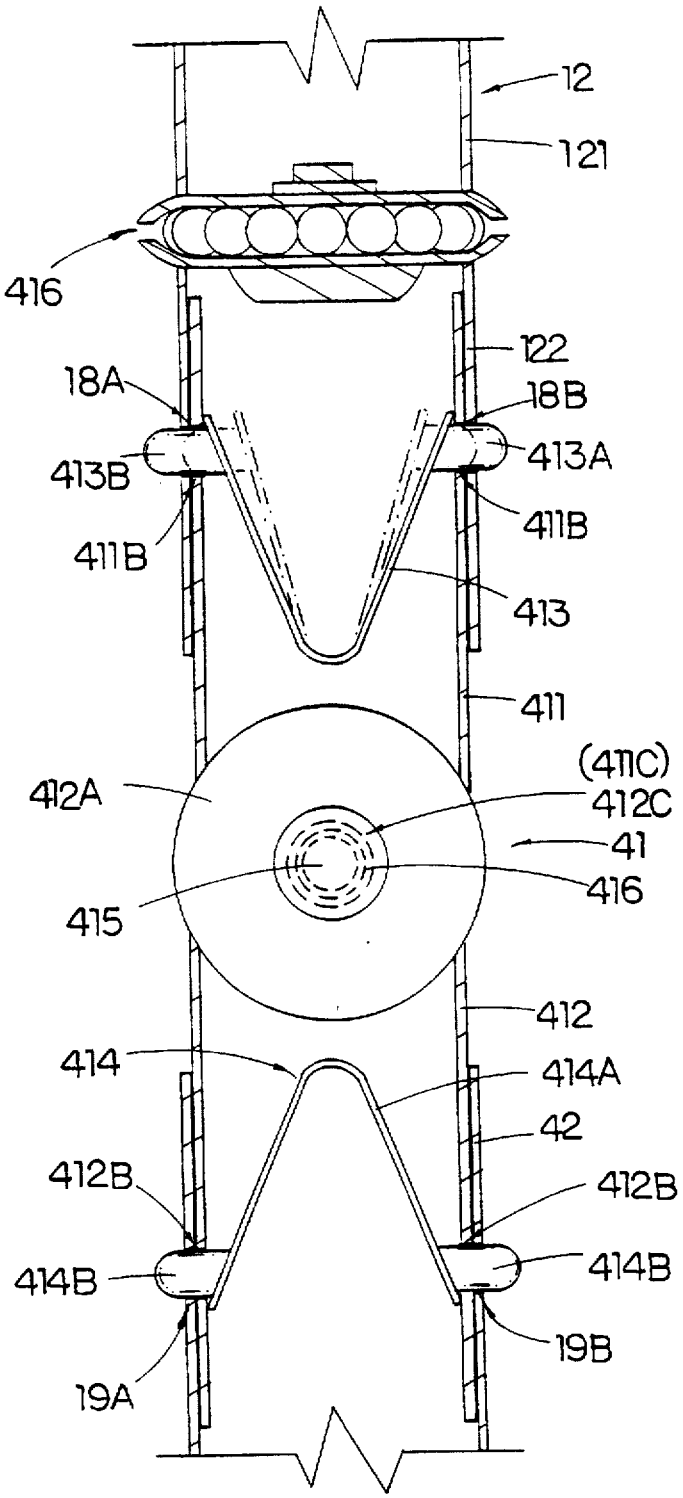
FIG. 5 is a sectional view of the connector installed between the hollow vertical tube of the T-shape supporter and the adjustable bar according to the above preferred embodiment of the present invention.

Referring to FIG. 4B, the left turning joint 21 further comprises a first joint disc 211*a* connected to one end of the first turning tube 211 and a second joint disc 212*a* connected to one end of the second turning tube 212. Each of the first and the second joint discs 212*a* has a center hole 211*c*, 212*c*. A central bolt 216 is penetrated through the two center holes 211*c*, 212*c* of the first and second joint discs 211*a*, 212*a*. A central spring 217 is positioned between the first and second joint discs 211*a*, 212*a*. A locking nut 215 is screwed on a free threaded end of the central bolt 216 for firmly pressing the first and second joint discs 211*a*, 212*a* together to avoid any inter-rotation between the T-shape supporter 10 and the left arm tube 22. However, by loosening the locking nut 215, the user can adjust the angle between the T-shape supporter 10 and the left arm tube 22. Therefore, the left turning joint 21 can be adjusted to different angle as desired by the user through first releasing the locking button 215, then adjusting the first turning tube 211 and the second turning tube 212 to the desired angle, and re-locking the locking button 215 in position.

The left arm tube 22 further comprises a protective sponge 23 enwrapping thereon to provide a comfortable supporting for the user's arm. During assembling, the first turning tube 211 is inserted into the left section of the hollow horizontal tube 11 until the first spring lock 213 is engaged with one of the connecting holes 14*a* or 15*a*. The second turning tube 212 is inserted into the straight end of the left arm tube 22 until the second spring lock 214 is engaged with one of the left arm holes 221 of the left arm tube 22, thereby the length of the left arm tube 22 can be adjusted according to the length of the arm of the user by engaging the second spring lock 214 with any one of the left arm holes 221.

The right arm supporter 30, as shown in FIG. 4A, which is identical to the left arm supporter 20, is connected to a right end of the right section of the hollow horizontal tube 11 of the T-shape supporter 10. The right arm supporter 30 comprises a right turning joint 31 and an elongated right arm tube 32. The right turning joint 31 comprises a first turning tube 311 inserted into the right end of the right section of the hollow horizontal tube 11 of the T-shape supporter 10, an second turning tube 312 inserted into a connecting end of the right arm tube 32, a first spring lock 313, and a second spring lock 314. The first spring lock 313 is disposed within the first turning tube 311 at a predetermined position thereof for engaging with the right section of the hollow horizontal tube 11 of the T-shape supporter 10. The second spring lock 314 is disposed within the second turning tube 312 at a predetermined position thereof for engaging with the right arm tube 32.

In order to firmly connect the right turning joint 31 with the right section of the hollow horizontal tube 11 and the right arm tube 32, each of the first and second spring locks 313, 314 (the first and second spring locks 213, 214 being identical in structure) also comprises a V-shape spring 313*a*, 314*a* which one end protrudes a locking stub 313*b*, 314*b*, so that the locking stub 313*b* of the first spring lock 313 penetrates through a first positioning hole 311*b* provided on the first turning tube 311 and further plugs through one of the first pair of connecting holes 14*b* or 15*b* formed on the right section of the hollow horizontal tube 11 of the T-shape supporter 10 while another end of the V-shape spring 313*a* pressing against an inner wall of the first turning tube 311. The locking stub 314*b* penetrates through a second positioning hole 312*b* provided on the second turning tube 312 and further plugs through one of a plurality of right arm holes 321 provided on one end of the right arm tube 32.

Referring to FIG. 4B, the right turning joint 31 comprises a first joint disc 311*a* connected to one end of the first turning tube 311 and a second joint disc 312*a* connected to one end of the second turning tube 312. Each of the first and second joint discs 312*a* has a center hole 311*c*, 312*c*. A central bolt 316 is penetrated through the two center holes 311*c*, 312*c* of the first and second joint discs 311*a*, 312*a*. A central spring 317 is positioned between the first and second joint discs 311*a*, 312*a*. A locking nut 315 is screwed on a free threaded end of the central bolt 316 for firmly pressing the first and second joint discs 311*a*, 312*a* together to avoid any inter-rotation between the T-shape supporter 10 and the right arm tube 32. However, by loosening the locking button 315, the user can adjust the angle between the T-shape supporter 10 and the right arm tube 32. Therefore, the right turning joint 31 can be adjusted to different angle as desired by the user through first releasing the locking button 315, then adjusting the first turning tube 311 and the second turning tube 312 to the desired angle, and re-locking the locking button 315 in position.

The right arm tube 32 further comprises a protective sponge 33 enwrapping thereon to provide a comfortable supporting for the user's arm. During assembling, the first turning tube 311 is inserted into the right section of the hollow horizontal tube 11 until the first spring lock 313 is engaged with one of the connecting holes 14*b* or 15*b*. The second turning tube 312 is inserted into the straight end of the right arm tube 32 until the second spring lock 314 is engaged with one of the right arm holes 321 of the right arm tube 32, thereby the length of the right arm tube 32 can be adjusted according to the length of the arm of the user by engaging the second spring lock 314 with any one of the right arm holes 321.

When the two first spring lock 213, 313 are inserted into the two connecting holes 14*a*, 14*b* of the T-shape supporter 10 respectively, the left arm supporter 20 and the right arm supporter 30 are opened wide to form the exercising twister and ready for exercising, as shown in FIGS. 3, 8 and 9. When the two first spring lock 213, 313 are inserted into the connecting holes 15*a*, 15*b* of the T-shape supporter 10 respectively, the left arm supporter 20 and the right arm supporter 30 can be folded downwardly to save spaced and form the clothes hanging stand for hanging clothes such as jacket, coat, or suit, as shown in FIGS. 1 and 2.

The adjustable device 40 comprises a central turning joint 41 and an adjustable bar 42. The central turning joint 41, which has an identical configuration as the left and right turning joints 21, 31, comprises a first turning tube 411 for inserting into a bottom end of the lower tube 122 of the vertical tube 12 of the T-shape supporter 10, a second turning tube 412 for inserting into a top end of the adjustable bar 42, a V-shape third spring lock 413, and a V-shape fourth spring lock 414. The third spring lock 413 is disposed within the first turning tube 411 at a predetermined position thereof for engaging with the lower tube 122 of the hollow vertical tube 12 of the T-shape supporter 10. The fourth spring lock 414 is disposed within the second turning tube 412 at a predetermined position for engaging with the adjustable bar 42.

In order to firmly connect the central turning joint 41 with the lower tube 122 of the hollow vertical tube 12 and the adjustable bar 42, the third and fourth spring locks 413, 414 are specially designed to each comprise a V-shape spring 413*a*, 414*a* which two ends protrude two locking stubs 413*b*, 414*b* respectively. As shown in FIG. 5, the two locking stubs 413*b* of the third spring lock 413 penetrate through two holding holes 411*b* provided on the first turning tube 411 respectively and further plug through the two jointing holes 18*a*, 18*b* formed near a bottom end of the lower tube 122 of the hollow vertical tube 12 respectively. The two locking stubs 414*b* of the fourth spring lock 414 penetrate through two holding holes 412*b* provided on the second turning tube 412 respectively and further plug through two side connecting holes 19*a*, 19*b* formed near a top end of the adjustable bar 42 respectively.

Identical to the left and right turning joints 21, 31, as shown in FIGS. 4A and 5, the central turning joint 41 further comprises a first joint disc 411 a connected to one end of the first turning tube 411 and a second joint disc 412*a* connected to one end of the second turning tube 412. Same as the first and second joint discs 211*a*, 311*a*, 212*a*, 312*a* of the left and right turning joints 21, 31, each of the first and second joint discs 411*a*, 412*a* also has a center hole 411*c*, 412*c*. A central bolt 415 is penetrated through the two center holes 411*c*, 412*c* of the first and second joint discs 411*a*, 412*a*. A central spring 416 is positioned between the first and second joint discs 411*a*, 412*a*. A locking nut 417 is screwed on a free threaded end of the central bolt 415 for firmly pressing the first and second joint discs 411*a*, 412*a* together to avoid any inter-rotation between the T-shape supporter 10 and the adjustable bar 42, as shown in FIG. 4A, 5 and 7A. However, by loosening the locking nut 417, the user can adjust the angle between the T-shape supporter 10 and the adjustable bar 42, as shown in FIG. 7B.

According to the first preferred embodiment of the present invention, as shown in FIG. 4B, the bottom surfaces of the joint discs 211*a*, 311*a*, 411*a* and the top surfaces of the joint discs 212*a*, 312*a*, 412*a* further provide a plurality of radial teeth 24 thereon respectively, so that the first and second joint discs 211*a*, 212*a* of the left turning joint 21, the first and second joint discs 311*a*, 312*a* of the right turning joint 31, and the first and second joint discs 411*a*, 412*a* of the central turning joint 41 can respectively be firmly engaged with each other to further ensure the locking effect.

Figure 6:
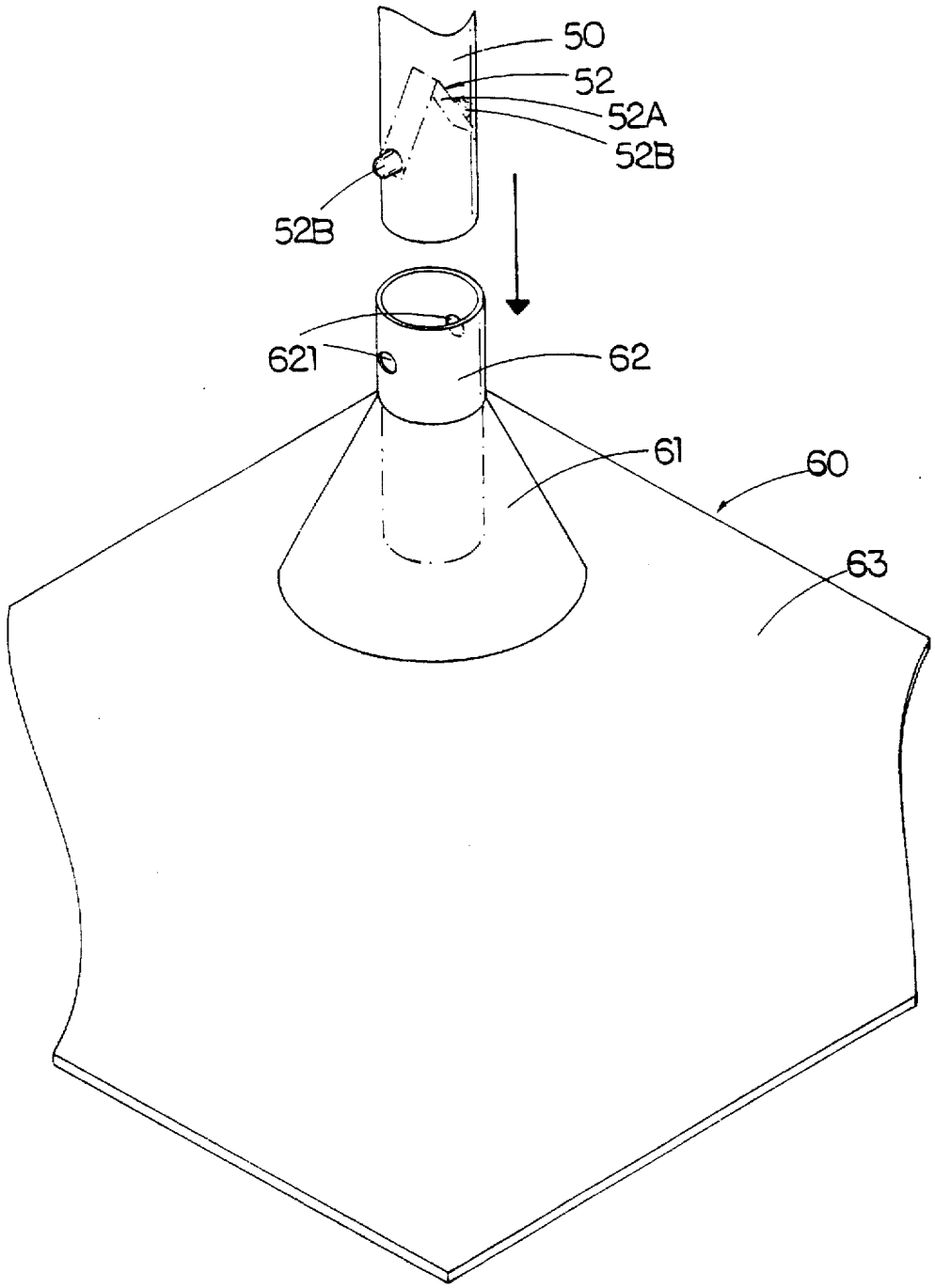
FIG. 6 is an explode perspective view of the base stand according to the above preferred embodiment of the present invention.

Referring to FIG. 4A, near a bottom end of the adjustable bar 42 has a lock hole 421 formed on one side thereof. Referring to FIGS. 3 and 4A, the base bar 50 has a plurality pair of adjusting holes 51 provided intervally and longitudinally along the base bar 50. An inner diameter of the base bar 50 is larger than an outer diameter of the adjustable bar 42, so that the adjustable bar 42 can be inserted into the base bar 50. The adjustable bar 42 and the base bar 50 can be connected by means of a fifth spring lock 418. The fifth V-shape spring lock 418, which has an identical configuration as the first and second spring locks 213, 214, 313, 314, comprises a V-shape spring 418*a* which one end protrudes a locking stub 418*b*, wherein the locking stub 418*b* penetrates through the lock hole 421 of the adjustable bar 42 and further plugs through any one of the adjusting holes 51 provided along the base bar 50. Therefore, the user may adjust the height of the adjustable clothes hanging and exercising apparatus. As shown in FIGS. 4A and 6, a sixth V-shape spring lock 52, which has an identical structure of the third and fourth spring locks 413, 414, is disposed within a bottom end of the base bar 50, wherein the sixth spring lock 52 comprises a V-shape spring 52*a* and two locking stubs 52*b* protruded respectively at two ends of the V-shape spring 52*a*. The two locking stubs 52*b* are penetrated through two bottom holes 53 of the base bar 50.

Referring to FIG. 6 of the drawing, the base supporter 60 comprises a conical stand 61, a receiving tube 62 extended upwardly from the conical stand 61, and a ground plate 63 with predetermined size and shape disposed underneath the circular stand 61 and connected with the receiving tube 62. The receiving tube 62 has two opening holes 621 formed on two opposite sides thereof An inner diameter of the receiving tube 62 is slightly larger than an outer diameter of the base bar 50 so that the bottom end of the base tube 50 can be inserted into the receiving tube 62. The base bar 50 can be rigidly supported by and firmly connected with the receiving tube 62 by further penetrating the two locking stubs 52*b* through the two opening holes 621.

All spring locks 213, 214, 313, 314, 411, 412, 418, and 52 of the present invention provide a novel locking feature that, for example, as shown in FIG. 5, when the two locking stubs 413*b* of the spring lock 413 are pressed inwardly by the user to compress the V-shape spring 413*a* inwardly (as shown in the dotted lines in FIG. 5), the two locking stubs 413*b* will move inwardly from the two jointing holes 18*a*, 18*b* but still retains at the two holding holes 411*b* to keep the spring lock 413 in position. At that moment, the locking condition between the lower tube 122 of the vertical tube 12 and the first turning tube 411 is released, so that the lower tube vertical tube 12 can be detached from the first turning tube 411.

Accordingly, the adjustable clothes hanging and exercising apparatus of the present invention can be disassembled to minimum its size while storing, packaging and shipping. The user can easily assemble all the parts together to form a clothes hanging stand as shown in FIGS. 1 and 2 to hang clothes. When a user U would like to have some twisting exercise, he or she may simply release the locking condition of the left turning joint 21 and the right turning joint 31 and turn the left arm supporter 20 with the left arm tube 22 and the right arm supporter 30 with the right arm tube 32 upwards until the two locking stubs 213*b*, 313*b* of the two first spring locks 213, 313 of the left and right turning joints 21, 31 inserting into the two connecting holes 14*a*, 14*b*. If the user U would like to do exercise in a sitting position, as shown in FIG. 9, or in a standing position, as shown in FIG. 8, the user U can adjust the total height of the adjustable bar 42 and the base bar 50 according to his or her height by selecting an upper pair or a lower pair of adjusting holes 51 on the base bar 50 to lock up by the fifth V-shape spring lock 418 with the locking holes 421 of the adjusting bar 42. Then the user U may release the locking of the two locking nuts 215, 315 and adjust the angle between the left and right arm supporters 20, 30 and the T-shape supporter 10 according to the arm shape of the user. After the above angle adjustment, the user U can re-lock the two locking nuts 215, 315 in tightly locked position. Moreover, the user U may also make an adjustment to the length of the left and right arm supporters 22, 32 by fitting the locking stubs 214*b*, 314*b* of the two second spring lock 214, 314 with different left and right arm holes 221, 321 respectively.

As shown in FIGS. 8 and 9, after the above adjustment, the user can grasp his or her two hands on the left and right arm supporters 22, 32 respectively and twist his or her body for relaxing, stretching, and improving blood circulation. As shown in FIGS. 7A, 7B, 8, and 9, the user may further slightly release the locking of the central turning joint 41, so that the T-shape supporter 10, as well as the left and right arm supporters 22, 32, can guide the left and right arms of the user to swing up and down. Practically, the user may twist his or her body and swing his or her arms at the same time to increase the exercising effect. During exercising, the user U should stand or sit on the ground plate 63, so that the weight of the user will further enhance the stability of the present invention, as shown in FIGS. 8 and 9.

Figure 10:
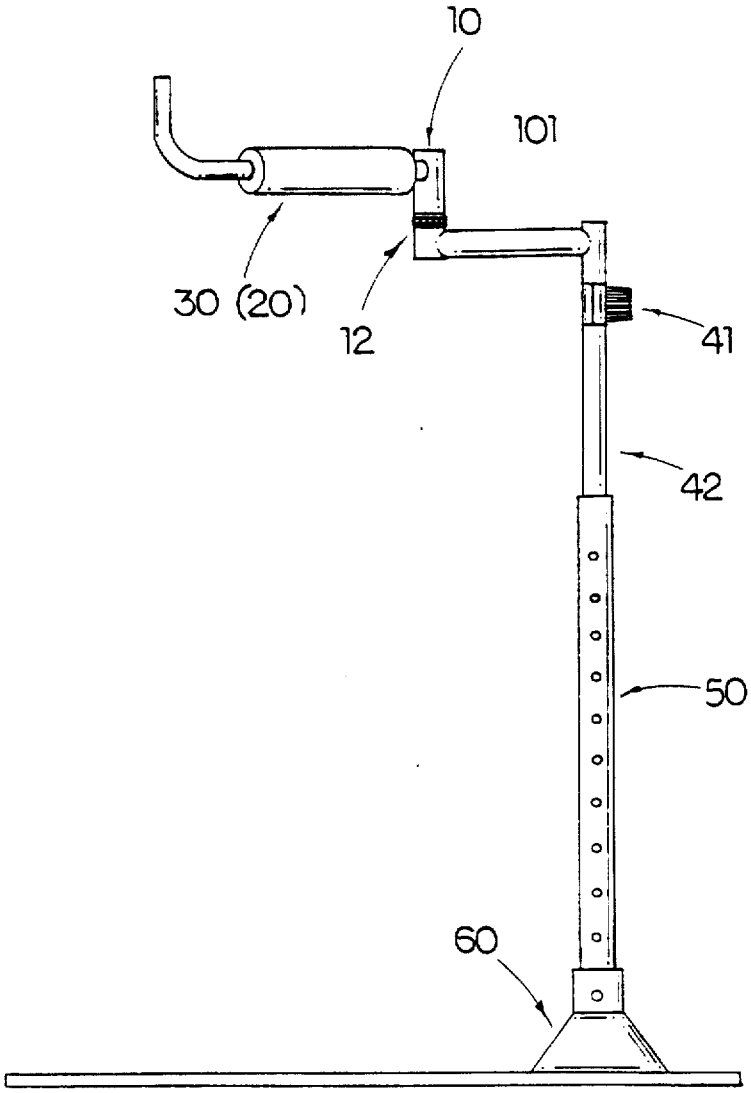
FIG. 10 is a side view of an alternative mode of the above preferred embodiment of the present invention.
Figure 11:
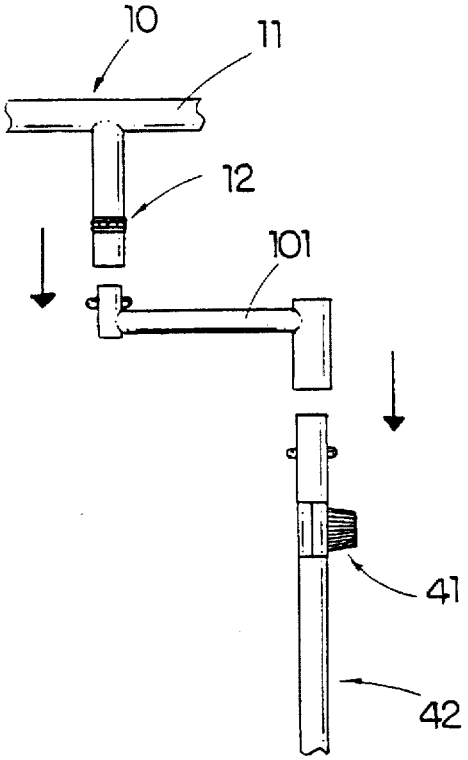
FIG. 11 is an exploded side view of the above alternative mode of the above preferred embodiment of the present invention with a coat hanging thereon.

Referring to FIG. 10, an alternative mode of the above first embodiment is illustrated, in which an additional extending tubular frame 101 is connected between the vertical tube 12 and the central turning joint 41, so as to extend the T-shape support 10 and the left and right arm supporters 22, 32 forward to fit the curve of the user's back.

Figure 12:
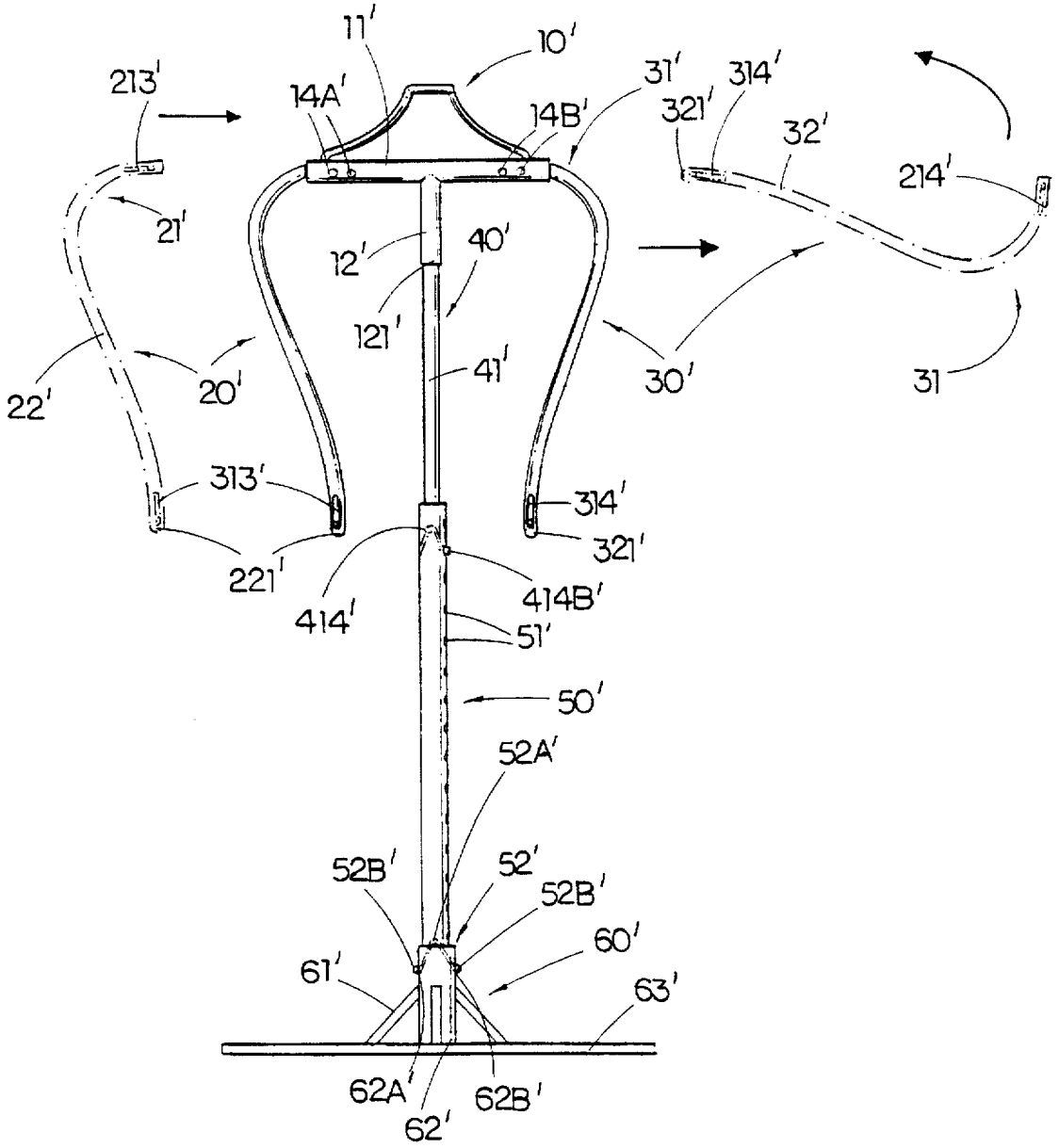
FIG. 12 is a front view of an adjustable clothes hanging and exercising apparatus according to a second preferred embodiment of the present invention, illustrating how to adjust the adjustable clothes hanging and exercising apparatus to form as a clothes hanging stand for hanging clothes.
Figure 14:
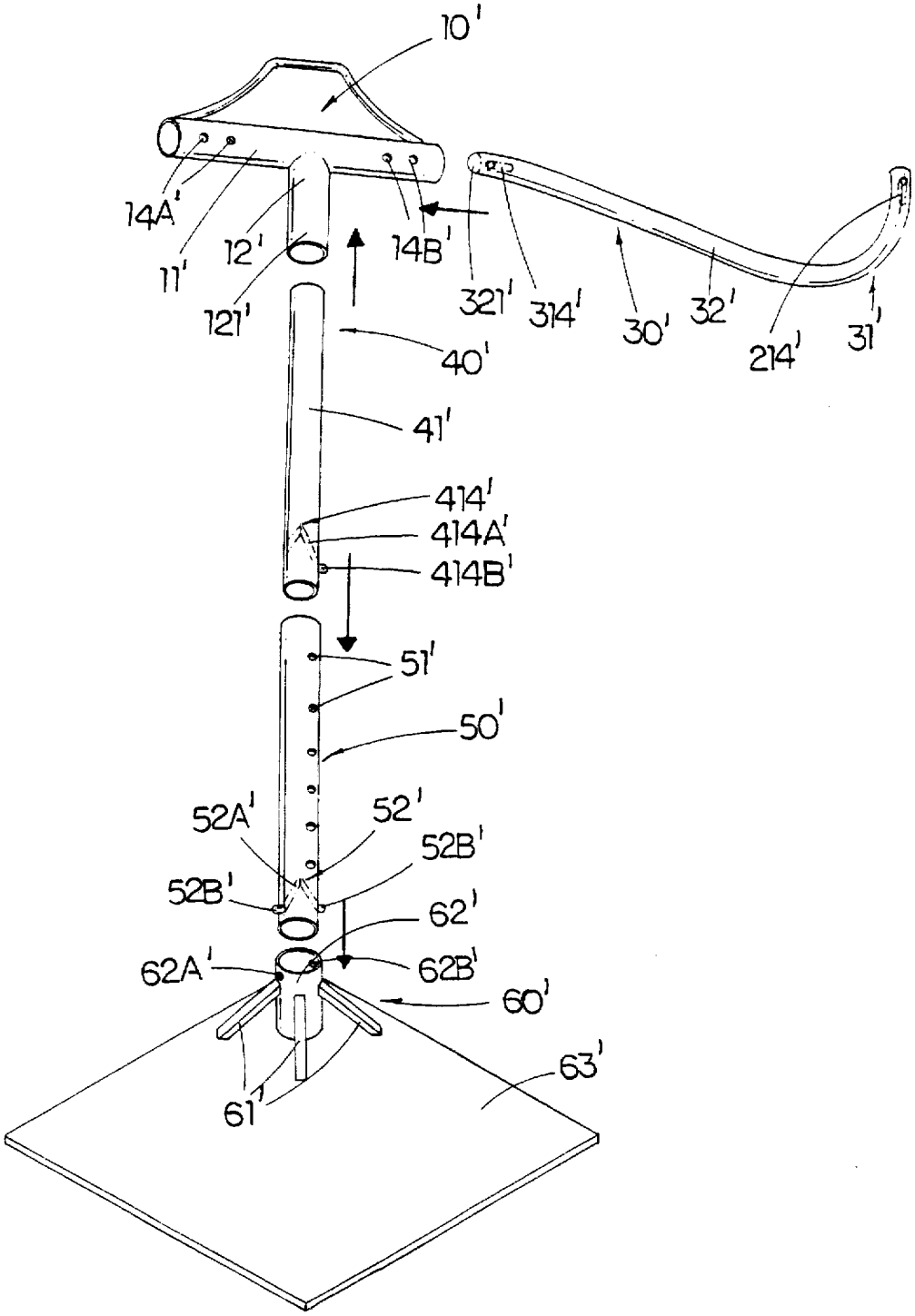
FIG. 14 is an exploded perspective view of the upper supporting device of the adjustable clothes hanging and exercising apparatus according to the above second preferred embodiment of the present invention.

Referring to FIGS. 12 and 14, a second preferred embodiment of the present invention is illustrated, which is a simplify modification of the above first embodiment, in which the left turning joint 21, the right turning joint 32 and the central turning joint 41 of the above first embodiment are eliminated. In this second embodiment, the adjustable clothes hanging and exercising apparatus of the present invention just comprises a T-shape supporter 10', a left arm supporter 20', a right arm supporter 30', an adjustable device 40' comprising a hollow adjustable tube 41', a base bar 50', and a base supporter 60'.

The T-shape supporter 10' comprises a hollow horizontal tube 11', a hollow vertical tube 12' perpendicularly and downwardly connected with a lower central portion of the horizontal tube 11'. The hollow vertical tube 12' has a bottom connecting end portion 121' having an inner diameter larger than an outer diameter of the adjustable tube 41'. The T-shape supporter 10' can be rotatably connected with the adjustable device 40' by inserting a top end of the adjustable tube 41' into the bottom connecting end portion 121' of the vertical tube 12'. The hollow horizontal tube 11' has at least two connecting holes 14*a*', 14*b*' provided near a left end and a right end thereof, wherein the two connecting holes 14*a*', 14*b*' are formed on a front side of the horizontal tube 11' with their central axes parallel to the ground.

The left and right arm supporters 20', 30' which are connected to the left side and the right side of the hollow horizontal tube 11' of the T-shape supporter 10' respectively. Each of the left and right arm supporters 20' comprises a curving joint 21', 31', and an arm tube 22', 32'. The curving joint 21' further comprises a first V-shape spring lock 213' disposed within an end of the curving joint 21' at a predetermined location for engaged the curving joint 21' to the opening hole 14*a*' of the hollow horizontal tube 11' of the T-shape supporter 10'. A second V-shape spring lock 214' is disposed within an end of the curving joint 31' at a predetermined location for engaged the curving joint 31' to the opening hole **14*b*' of the hollow horizontal tube 11' of the T-shape supporter 10'**.

The outer diameter of the left and right arm tubes 22', 32' is smaller than the inner diameter of the hollow horizontal tube 11' of the T-shape supporter 10' respectively. The outer diameter of the curving joint 21' or 31' is also smaller than the inner diameter of the hollow horizontal tube 11' of the T-shape supporter 10' respectively, so that the end of the curving joint 21' can be inserted into the left end of the hollow horizontal tube 11' until the first V-shape spring lock 213' is engaged with the opening hole **14*a*'. An end of the curving joint 31' can be inserted into the right end of the hollow horizontal tube 11' until the second V-shape spring lock 214' is engaged with the opening hole 14*b*', in order to assemble a clothes hanging stand, as shown in FIG. 12**.

Figure 13:
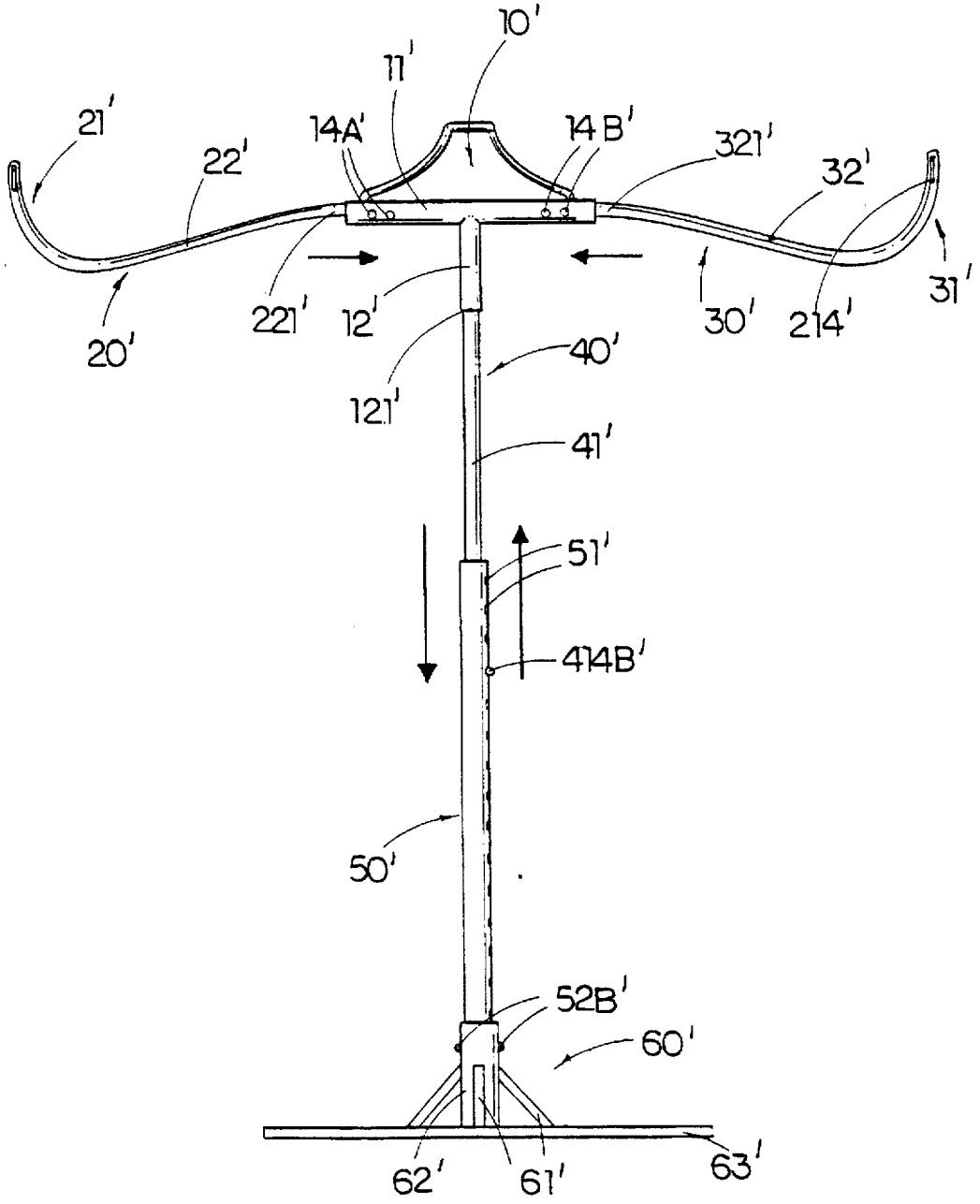
FIG. 13 is a perspective of the adjustable clothes hanging and exercising apparatus according to the above second preferred embodiment of the present invention, in which the adjustable clothes hanging and exercising apparatus is set as an exercising twister.

The left and right arm tubes 22', 32' further comprise a third and fourth V-shape spring locks 313', 314' disposed within an tube end 221', 321' of each of the left and right arm tubes 22', 32' respectively for engaging the tube ends 221', 321' of the left and right arm tubes 22' 32' with the left and right sides of the T-shape supporter 10' respectively to form an exercising twister, as shown in FIG. 13.

The adjustable device 40' comprises an adjustable bar 41', in which the adjustable bar 41' further comprises a fifth V-shape spring lock 414' which has an identical configuration as the V-shape spring locks 213, 214, 313, 314 disclosed in the above first preferred embodiment. The fifth V-shape spring lock 414' is disposed within the adjustable bar 41' at a predetermined location for engaging the adjustable bar 41' to the base bar 50'. An outer diameter of the adjustable bar 41' is smaller than an inner diameter of the hollow vertical tube 12', so that a top end of the adjustable bar 42' is able to rotatably inserted into a bottom end of the hollow vertical tube 12'.

The base bar 50' comprises a plurality of opening holes 51' at evenly space interval at predetermined location. An inner diameter of the base bar 50' is larger than an outer diameter of the adjustable bar 41', so that a bottom end of the adjustable bar 41' can be inserted into a top end of the base bar 50', wherein the height of the adjustable clothes hanging apparatus, depending on the height of the user, can be adjusted by plugging a lock stub **414*b*' which is protruded from one end of a V-shape spring 414*a*' of the fifth V-shape spring lock 414' through any one of the opening holes 51' provided along the base bar 50'. At a bottom portion of the base bar 50' provided a sixth V-shape spring lock 52'** disposed at a predetermined location.

The base supporter 60' comprises a three legs triangular stand 61', a receiving tube 62' supported by the three legs triangular stand 61', and a ground plate 63' with predetermined size and shape disposed underneath the three legs triangular stand 61', in which the receiving tube 62' further comprises two opening holes **62*a*', 62*b*' disposed at two opposite sides thereof. An inner diameter of the receiving tube 62' is slightly larger than the outer diameter of the base bar 50', so that two locking plugs 52*b*' protruded from two ends of the sixth V-shape spring lock 52' can be plugged through the opening holes 62*a*', 62*b*' of the receiving tube 62', in order to firmly locking the base bar 50' to the base supporter 63'**.

I claim:

1. An adjustable clothes hanging and exercising apparatus, comprising an upper supporting device comprising a T-shape supporter which comprises a horizontal tube having a left section and a right section, and a vertical tube downwardly and perpendicularly connected between said left section and said right section of said horizontal tube, wherein said vertical tube comprises an upper tube, a lower tube and a roller connector connected between said upper tube and said lower tube for enabling said upper tube and said lower tube to rotate relatively and enhancing a smooth connection between said upper tube and said lower tube;

a left arm supporter which comprises an elongated left arm tube and a left turning joint detachably and rotatably connected between a left end of said left section of said horizontal tube and a connecting end of said left arm tube; and a right arm supporter which comprises an elongated right arm tube and a right turning joint detachably and rotatably connected between a right end of said right section of said horizontal tube and a connecting end of said right arm tube;

an adjustable device which comprises an adjustable bar and an central turning joint detachably connected between a bottom end of said lower tube of said vertical tube and a top end of said adjustable bar;

a base bar detachably connected with a bottom end of said adjustable bar, wherein said bottom end of said adjustable bar is selectively inserted into a top end of said base bar for a predetermined depth so as to adjust an overall height of said adjustable bar and said base bar; and a base supporter detachably connected with a bottom end of said base bar.

2. An adjustable clothes hanging and exercising apparatus, as recited in claim 1, in which each of said left turning joint, said right turning joint and said central turning joint comprises a first turning tube for inserting into said left end of said left section of said horizontal tube, said right end of said right section of said horizontal tube and said bottom end of said lower tube of said vertical tube respectively;

an second turning tube for inserting into said connecting ends of said left and right arm tubes and said top end of said adjustable bar respectively;

a first joint disc connected to one end of said first turning tube and a second joint disc connected to one end of said second turning tube, in which each of said first and said second joint discs has a center hole;

a central bolt which is penetrated through said two center holes of said first and second joint discs;

a central spring which is positioned between said first and second joint discs; and a locking nut which is screwed on a free threaded end of said central bolt for firmly pressing said first and second joint discs together to avoid any inter-rotation between said first and second joint discs, and that by loosening said locking nut, said second joint disc is able to rotate with respect to said first joint disc.

3. An adjustable clothes hanging and exercising apparatus, as recited in claim 2, in which an inner surface of each of said first and second joint discs provides a plurality of radial teeth, so that said first and second joint discs are able to be firmly engaged with each other for ensuring the locking effect therebetween.

4. An adjustable clothes hanging and exercising apparatus, as recited in claim 2, further comprising two first spring lock disposed within said two first turning tubes of said left and right turning joints respectively for detachably engaging with said left and right sections of said horizontal tube of said T-shape supporter.

5. An adjustable clothes hanging and exercising apparatus, as recited in claim 4, in which at least two pair of connecting holes provided at a predetermined position on said hollow horizontal tube, in which one pair of said connecting holes are formed on said left section of said horizontal tube while another pair of said connecting holes are formed on a right section of said horizontal tube, each pair of said connecting holes having an upper connecting hole formed on a front side of said horizontal tube, each pair of said connecting holes having a lower connecting hole formed on a bottom side of said horizontal tube.

6. An adjustable clothes hanging and exercising apparatus, as recited in claim 5, in which each of said first spring locks comprises a V-shape spring which one end protrudes a locking stub, wherein said two locking stubs of said two first spring locks penetrate through two first positioning holes provided on said first turning tubes of said left and right turning joints respectively, each said locking stub further plugging through one of each pair of connecting holes formed on said left and right sections of said horizontal tube of said T-shape supporter respectively, wherein another end of each said V-shape spring pressing against on an inner wall of said respective first turning tube.

7. An adjustable clothes hanging and exercising apparatus, as recited in claim 6, further comprising two second spring locks which are disposed within said second turning tubes of said left and right turning joints for detachably engaging with said left and right arm tubes respectively.

8. An adjustable clothes hanging and exercising apparatus, as recited in claim 7, in which each of said second spring locks also comprises a V-shape spring which one end protrudes a locking stub, wherein said two locking stubs of said two second spring locks penetrate through two second positioning holes provided on said second turning tubes of said left and right turning joints respectively, said locking stub of one of said second spring locks which is disposed within said left second turning tube of said left turning joint further plugging through one of a plurality of left arm holes provided on one end of said left arm tube, said locking stub of said another second spring lock which is disposed within said right second turning tube of said right turning joint further plugging through one of a plurality of right arm holes provided on one end of said right arm tube.

9. An adjustable clothes hanging and exercising apparatus, as recited in claim 8, in which each of said left and right arm tubes further comprises a protective sponge enwrapping thereon.

10. An adjustable clothes hanging and exercising apparatus, as recited in claim 8, further comprising a third spring lock which is disposed within said first turning tube of said central turning joint at a predetermined position thereof for engaging with said lower tube of said vertical tube of said T-shape supporter, and a fourth spring lock which is disposed within said second turning tube of said central turning joint at a predetermined position for engaging with said adjustable bar.

11. An adjustable clothes hanging and exercising apparatus, as recited in claim 10, in which said T-shape supporter has two jointing holes formed at two opposite sides of said lower tube of said vertical tube, wherein each of said third and fourth spring locks comprise a V-shape spring which two ends protrude two locking stubs respectively, wherein said two locking stubs of said third spring lock are penetrated through two holding holes provided on said first turning tube respectively and further plugged through said two jointing holes formed near said bottom end of said lower tube of said hollow vertical tube respectively, and that said two locking stubs of said fourth spring lock are penetrated through two holding holes provided on said second turning tube respectively and further plugged through two side connecting holes formed near said top end of said adjustable bar respectively.

12. An adjustable clothes hanging and exercising apparatus, as recited in claim 11, in which near said bottom end of said adjustable bar, a lock hole is formed on one side thereof, said base bar having a plurality pair of adjusting holes provided intervally and longitudinally along said base bar, said adjustable bar and said base bar being connected by means of a fifth spring lock which comprises a V-shape spring which one end protrudes a locking stub, wherein said locking stub penetrates through said lock hole of said adjustable bar and further plugs through one of said adjusting holes provided along said base bar.

13. An adjustable clothes hanging and exercising apparatus, as recited in claim 1, in which said base supporter comprises a conical stand, a receiving tube extended upwardly from said conical stand for receiving said bottom end of said base bar, and a ground plate with predetermined size and shape disposed underneath said circular stand and connected with said receiving tube.

14. An adjustable clothes hanging and exercising apparatus, as recited in claim 12, in which said base supporter comprises a conical stand, a receiving tube extended upwardly from said conical stand for receiving said bottom end of said base bar, and a ground plate with predetermined size and shape disposed underneath said circular stand and connected with said receiving tube.

15. An adjustable clothes hanging and exercising apparatus, as recited in claim 14, furthering comprising a sixth spring lock which is disposed within said bottom end of said base bar and comprises a V-shape spring and two locking stubs protruded respectively at two ends of said V-shape spring, and that said receiving tube has two opening holes formed on two opposite sides thereof, wherein said two locking stubs are penetrated through two bottom holes of said base bar and further plugged through said two opening holes respectively.

16. An adjustable clothes hanging and exercising apparatus, as recited in claim 1, in which said upper supporting device further comprises an additional extending tubular frame which is connected between said vertical tube and said central turning joint, so as to extend said T-shape support and said left and right arm supporters forwards.

17. An adjustable clothes hanging and exercising apparatus, as recited in claim 15, in which said upper supporting device further comprises an additional extending tubular frame which is connected between said vertical tube and said central turning joint, so as to extend said T-shape support and said left and right arm supporters forwards.

18. An adjustable clothes hanging and exercising apparatus, comprising an upper supporting device which comprises a T-shape supporter comprising a horizontal tube having a left section and a right section and a vertical tube integrally and perpendicularly connected with a lower central portion of said horizontal tube;

a left arm supporter having a first end and a second end, wherein one of said first and second ends is detachably connected with said left section of said horizontal tube; and a right arm supporter having a first end and a second end, wherein one of said first and second ends is detachably connected with said right section of said horizontal tube;

an adjustable device which comprises an adjustable bar having a top end rotatably connected with a bottom end of said vertical tube;

a base bar having a top end detachably connected with a bottom end of said adjustable bar; and a base supporter detachably connected with a bottom end of said base bar.

19. An adjustable clothes hanging and exercising apparatus, as recited in claim 18, in which said vertical tube has a bottom connecting end portion having an inner diameter larger than an outer diameter of said adjustable tube, said T-shape supporter is rotatably connected with said adjustable device by inserting a top end of said adjustable tube into said bottom connecting end portion of said vertical tube.

20. An adjustable clothes hanging and exercising apparatus, as recited in claim 19, in which said horizontal tube has at least two connecting holes provided on a font side of a left end and a right end of said left and right sections respectively, said left and right arm supporters which are connected to said left and right sections of said horizontal tube of said T-shape supporter respectively, each of said left and right arm supporters comprising a curving joint and an arm tube.

21. An adjustable clothes hanging and exercising apparatus, as recited in claim 20, in which said curving joint further comprises a first spring lock disposed within an end of said curving joint at a predetermined location for engaged said curving joint to said opening hole of said horizontal tube of said T-shape supporter, a second spring lock being disposed within an end of said curving joint at a predetermined location for engaged said curving joint to said opening hole of said hollow horizontal tube of said T-shape supporter, an outer diameter of each said curving joint is smaller than an inner diameter of said horizontal tube of said T-shape supporter respectively, said end of said curving joint of said left arm supporter is inserted into said left end of said horizontal tube until said first spring lock is engaged with said opening hole, said end of said curving joint of said right arm supporter is inserted into said right end of said hollow horizontal tube until said second spring lock is engaged with said opening hole.

22. An adjustable clothes hanging and exercising apparatus, as recited in claim 20, in which an outer diameter of said left and right arm tubes being smaller than an inner diameter of said horizontal tube of said T-shape supporter respectively, and that said left and right arm tubes comprises a third and a fourth spring lock disposed within an tube end of each of said left and right arm tubes respectively for engaging said tube ends of said left and right arm tubes with said left and right sides of said T-shape supporter respectively.

23. An adjustable clothes hanging and exercising apparatus, as recited in claim 21, in which said adjustable bar further comprises a fifth spring lock which is disposed within said adjustable bar at a predetermined location for engaging said adjustable bar to said base bar, said base bar comprising a plurality of opening holes at evenly space interval at predetermined location, an inner diameter of said base bar being larger than an outer diameter of said adjustable bar, so that said bottom end of said adjustable bar is inserted into said top end of said base bar, wherein a lock stub protruded from one end of a V-shape spring of said fifth spring lock is plugged through one of said opening holes provided along said base bar, a sixth spring lock is disposed within a bottom portion of said base bar, said base supporter comprising a stand, a receiving tube supported by said stand, and a ground plate with predetermined size and shape disposed underneath said stand, in which said receiving tube further comprises two opening holes disposed at two opposite sides thereof, an inner diameter of said receiving tube being slightly larger than said outer diameter of said base bar, so that two locking plugs protruded from two ends of a V-shape spring of said sixth spring lock are plugged through said opening holes of said receiving tube in order to firmly locking said base bar to said base supporter.

24. An adjustable clothes hanging and exercising apparatus, as recited in claim 22, in which said adjustable bar further comprises a fifth spring lock which is disposed within said adjustable bar at a predetermined location for engaging said adjustable bar to said base bar, said base bar comprising a plurality of opening holes at evenly space interval at predetermined location, an inner diameter of said base bar being larger than an outer diameter of said adjustable bar, so that said bottom end of said adjustable bar is inserted into said top end of said base bar, wherein a lock stub protruded from one end of a V-shape spring of said fifth spring lock is plugged through one of said opening holes provided along said base bar, a sixth spring lock is disposed within a bottom portion of said base bar, said base supporter comprising a stand, a receiving tube supported by said stand, and a ground plate with predetermined size and shape disposed underneath said stand, in which said receiving tube further comprises two opening holes disposed at two opposite sides thereof, an inner diameter of said receiving tube being slightly larger than said outer diameter of said base bar, so that two locking plugs protruded from two ends of a V-shape spring of said sixth spring lock are plugged through said opening holes of said receiving tube in order to firmly locking said base bar to said base supporter.

* * * * *